US007950755B2

(12) United States Patent
Vardon

(10) Patent No.: US 7,950,755 B2
(45) Date of Patent: May 31, 2011

(54) SHELF, PARTICULARLY FOR REFRIGERATION UNITS, WHICH IS DESIGNED TO SUPPORT AT LEAST ONE ACCESSORY AND CORRESPONDING ACCESSORIES

(75) Inventor: Francois Vardon, Queretaro (MX)

(73) Assignee: Saint-Gobain Glass France, Courbevoie (FR)

( * ) Notice: Subject to any disclaimer, the term of this patent is extended or adjusted under 35 U.S.C. 154(b) by 305 days.

(21) Appl. No.: 11/720,610

(22) PCT Filed: Nov. 30, 2005

(86) PCT No.: PCT/FR2005/051008

§ 371 (c)(1), (2), (4) Date: Jun. 1, 2007

(87) PCT Pub. No.: WO2006/059038

PCT Pub. Date: Jun. 8, 2006

(65) Prior Publication Data

US 2009/0134758 A1 May 28, 2009

(30) Foreign Application Priority Data

Dec. 3, 2004 (FR) ..... 04 52866

(51) Int. Cl.
*A47B 96/02* (2006.01)

(52) U.S. Cl. ..... 312/408

(58) Field of Classification Search ..... 108/106–110; 312/404, 408, 410, 351

See application file for complete search history.

(56) References Cited

U.S. PATENT DOCUMENTS

| | | | | | |
|---|---|---|---|---|---|
| 2,588,618 | A | * | 3/1952 | Di Renzo | 312/49 |
| 2,755,158 | A | * | 7/1956 | Davidson | 312/404 |
| 2,757,061 | A | * | 7/1956 | Anderson | 312/313 |
| 3,168,365 | A | * | 2/1965 | Evans | 312/351 |
| 4,528,825 | A | | 7/1985 | Khan | |
| 4,633,789 | A | * | 1/1987 | Kortering et al. | 108/152 |
| 4,936,641 | A | * | 6/1990 | Bussan et al. | 312/408 |
| 4,938,442 | A | * | 7/1990 | Mastrodicasa | 248/250 |
| 5,273,354 | A | * | 12/1993 | Herrmann et al. | 312/408 |

(Continued)

FOREIGN PATENT DOCUMENTS

DE 196 31 374 2/1998

(Continued)

OTHER PUBLICATIONS

U.S. Appl. No. 12/514,467, filed May 12, 2009, Leconte, et al.

*Primary Examiner* — Janet M Wilkens
(74) *Attorney, Agent, or Firm* — Oblon, Spivak, McClelland, Maier & Neustadt, L.L.P.

(57) ABSTRACT

A shelf for a piece of furniture, or for a refrigerator or similar element, including a panel for supporting articles and at least one structure made of plastic on at least one region of the periphery of the panel. The structure is configured to allow the shelf to be installed in a frame of the piece of furniture. The structure supports, at least on one of its two faces situated in the plane of the panel, a mechanism of attaching an accessory intended to be placed, in a position of use, in a free space of the corresponding side of the shelf.

15 Claims, 4 Drawing Sheets

U.S. PATENT DOCUMENTS

| | | | | | |
|---|---|---|---|---|---|
| 5,323,917 | A | * | 6/1994 | Johnson et al. | 211/74 |
| 5,564,809 | A | * | 10/1996 | Kane et al. | 312/408 |
| 5,626,407 | A | * | 5/1997 | Westcott | 312/408 |
| 5,641,217 | A | * | 6/1997 | Caruso et al. | 312/404 |
| 5,705,113 | A | * | 1/1998 | Kane et al. | 264/261 |
| 5,749,241 | A | * | 5/1998 | Ryu et al. | 62/340 |
| 5,947,036 | A | * | 9/1999 | Cohen | 108/110 |
| 6,015,053 | A | * | 1/2000 | Sheng | 211/188 |
| 6,340,145 | B1 | * | 1/2002 | Tagami et al. | 248/317 |
| D482,261 | S | * | 11/2003 | Kobayashi | D8/349 |
| 6,880,902 | B2 | * | 4/2005 | Zimmerman | 312/404 |

FOREIGN PATENT DOCUMENTS

| | | |
|---|---|---|
| DE | 198 21 824 | 11/1999 |
| DE | 103 39 942 | 3/2005 |
| WO | 2005 059458 | 6/2005 |

* cited by examiner

SHELF, PARTICULARLY FOR REFRIGERATION UNITS, WHICH IS DESIGNED TO SUPPORT AT LEAST ONE ACCESSORY AND CORRESPONDING ACCESSORIES

The present invention relates to a shelf or tray for supporting articles, intended to be fixed or mounted, advantageously removably, in the frame of a piece of furniture. In particular, it relates to a shelf capable of being used in refrigerated compartments, such as refrigerated cabinets, cooling apparatus, refrigerators, for supporting articles, particularly foodstuffs.

These shelves consist of solid plates made of mineral or organic glass such as polycarbonate or poly(methyl methacrylate), monolithic or laminated, transparent, translucent or opaque, furnished with a total or partial surround made of plastic making it possible to prevent risks of injuries on the sharp edges of the plates and/or to reinforce said plates.

Furthermore, the edges of the plastic surround may be straight and uniform or of more complex shape, capable in particular of having parts or peripheral extensions for functional or esthetic purposes. This is why the front edge may form a handle for manipulating the shelf and the side and rear edges are usually adapted to interact with the frame of the piece of furniture, which usually supports racks to support the shelves.

There are various methods of assembling the plastic surround onto the panel, by encapsulation molding, or by fitting a surround to the panel, for example by bonding, clipping or interlocking sides of the surround or else by retraction of the surround just after molding, the panel, in this case, being assembled to the surround on leaving the mould before the complete retraction of the plastic.

These shelves give satisfaction by their practical and esthetic shapes, and also because the assembly methods, in particular by retraction, make it possible to obtain a good fixed attachment and, where appropriate, a good seal between the glass panel and the plastic surround.

However, there is currently a demand for internal arrangements of more complex pieces of furniture, allowing a better organization of the space between two shelves.

The filing Company has therefore looked for simple and effective means of achieving this objective, and it has for this purpose perfected shelves capable of supporting at least one accessory intended to be placed in a free space between two shelves and to allow in particular a better organized storage of articles, an example of such an accessory being a bottle-holder accessory supported by the bottom face of the plastic surround of a shelf.

A practical problem that then arises is that the traction that is exerted on the plastic surround to which is coupled an accessory which, once loaded, weighs heavy (a full bottle in the bottle-holder) must not cause a loss of the seal between the glass and the plastic and/or a mechanical weakening of the surround.

The present invention proposes means of providing a solution to this problem.

Therefore the subject of the present invention is first a shelf for a piece of furniture, particularly for a refrigerator or similar element, comprising a panel for supporting articles and at least one structure made of plastic on at least one region of the periphery of the panel, said structure being arranged to allow said shelf to be installed in the frame of said piece of furniture, characterized in that said structure supports, at least on one of its two faces situated in the plane of the panel, a means of attaching an accessory intended to be placed, in the position of use, in the free space of the corresponding side of the shelf.

Preferably, the plastic structure is an attached (or added) structure (not formed directly on the panel but formed separately, or preformed, before being assembled to the panel), this structure being for example advantageously assembled by the aforementioned retraction method. There is however nothing against the plastic structure being directly formed on the panel for example by encapsulation.

The or each accessory (also capable of advantageously being made of plastic as illustrated hereinafter) advantageously supports an attachment means complementary to the attachment means supported by said plastic structure.

The attachment means supported by the structure and by the accessory or accessories may be arranged to make it possible to install the accessory or accessories removably.

The attachment means may advantageously consist of L-shaped parts allowing a coupling by reciprocal interweaving (or interlocking), the L-shaped parts supported by the plastic structure being advantageously obtained by molding (during the molding of the structure for example) and those supported by the accessory consisting advantageously of a rim formed at one of the ends of the latter (also capable of being obtained by molding), means furthermore being capable of being advantageously provided for preventing a relative movement of the accessory in the horizontal plane once installed. Advantageously, the coupling of the accessory may be achieved on a single side as illustrated hereinafter.

According to a particularly preferred embodiment, the plastic structure comprises at least one rim applied to the panel for supporting the articles on at least one of the two faces of said panel, the means of attaching the accessory or accessories being preferably supported by this rim. In particular, the plastic structure may be a frame or a portion of frame enclosing the panel via its actual surrounding part, which has at least one rim coming to press (or apply) under the panel and advantageously forming at least one maintaining (or retention) lug, and preferably at least one of these maintaining lugs supports a means of attaching an accessory.

The coupling member appears thus and preferably in the form of a U-shaped element, one of whose flanges (internal flange) may be added to the structure or be one and the same with part of the structure such as a maintaining lug in the case of the structure that has just been described, the other flange (external flange) and the web contributing to the coupling as aforementioned (L-shape).

Such U-shaped systems (called "double lugs") particularly supported (or integrated) by the rim or the maintaining lugs are particularly preferred because they provide a combination of effects: in particular better mechanical strength of the frame and better sealing between panel and frame because the latter is no longer directly acted upon.

The web of a U-shaped element may be situated in the extension of the actual surround of the frame enclosing the panel, and the external flange may come to overhang the panel.

The means preventing the accessory from moving in the horizontal plane once installed may in particular be clipping means consisting of bulges or bosses and/or abutment means both in the longitudinal direction and in the transverse direction.

In the case of the abovementioned embodiment, a boss supported by the plastic structure may be placed in the web of the U-shaped element and a boss supported by the accessory may be formed by a bulge formed along its coupling border, said coupling border having a thickness allowing it to come and be positioned between the two flanges of the U-shaped element.

The flanges of the U-shaped element may have inclined borders and the border by which the accessory penetrates by sliding between the two flanges of the U-shaped element may also be in the form of a ramp in order to facilitate the guidance followed by the clipping of a boss supported by the accessory behind a boss supported internally by the U-shaped element.

Provision may also be made for the rim for coupling the accessory to comprise at least one elongated opening whose internal longitudinal edge has a recess to form a region for a U-shaped element to pass and a coupling border part supporting the bulge for the clipping, the opening allowing the sliding guidance of the accessory in order to couple it followed by the clipping, the accessory being retained in the horizontal plane by the external edge of the opening butting against the web of the U-shaped element and by the edge of the U-shaped element butting against a transverse side of the opening, opposite the clipping region.

The present invention also relates to the shelf that has just been described with its associated accessory or accessories, or to a kit formed by said shelf and its associated accessory or accessories. The invention finally relates to a piece of furniture such as a refrigerated cabinet, cooling apparatus or refrigerator, comprising at least one shelf as defined hereinabove.

To better illustrate the shelf adapted according to the present invention to support an accessory, a particular embodiment will be described hereinafter with reference to the appended drawings.

Figure 1:
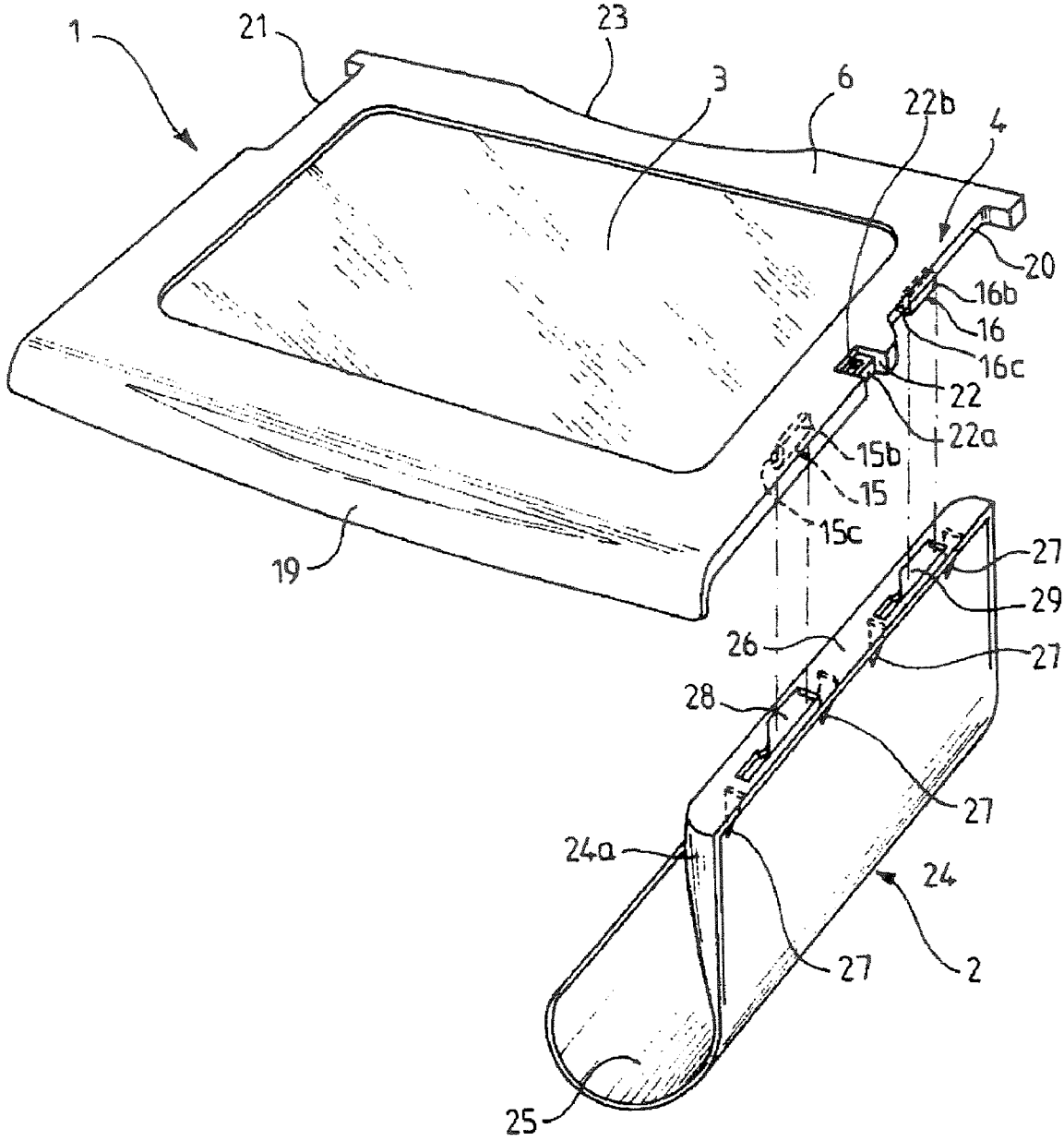
FIG. 1 is an exploded view in perspective of the shelf for a refrigerator according to this embodiment, with its bottle-holder accessory.

With reference to FIG. 1, it can be seen that, in exploded perspective, a shelf 1 for a refrigerator has been shown, with its bottle-holder accessory 2.

In the following description of these two parts, the terms "front", "rear", "right", "left", "lower", "upper", "vertical", "horizontal" and the equivalent expressions will be used with reference to their position in place in a refrigerator, the user facing the shelf in question.

The shelf 1 consists of a panel 3 made of mineral or organic glass, rectangular, furnished with a frame 4 made of relatively rigid plastic, such as polypropylene.

Figure 4:
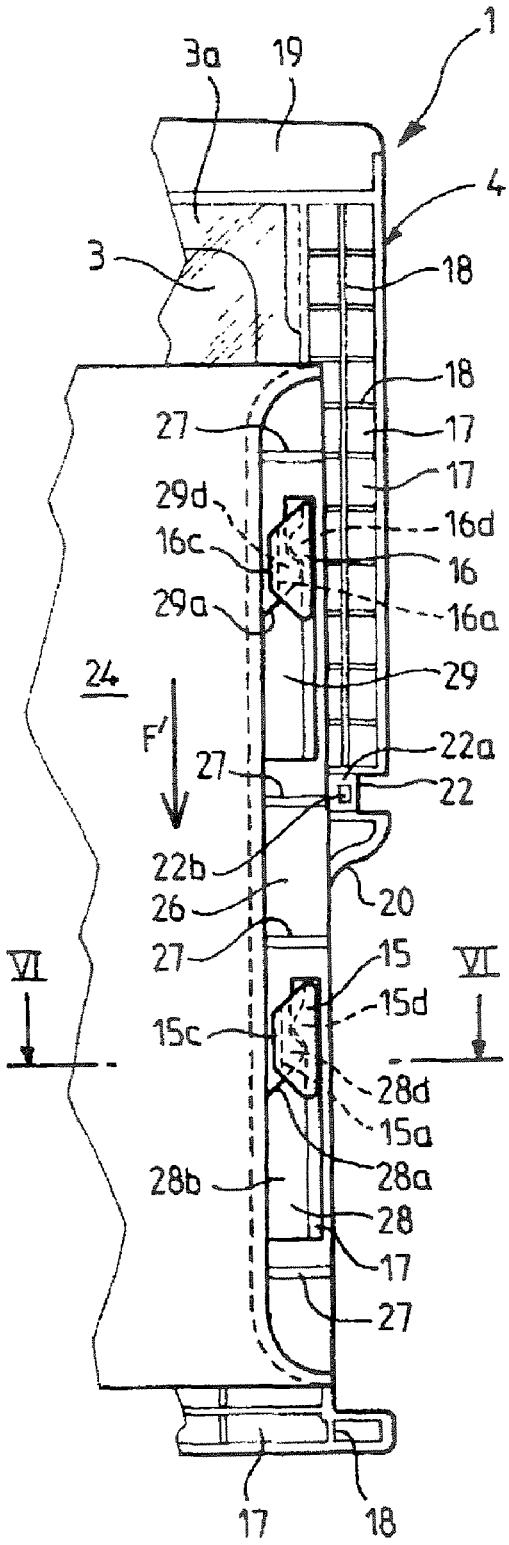
FIG. 4 is a view similar to FIG. 3, showing the shelf fitted with its bottle-holder accessory after clipping.
Figure 5:
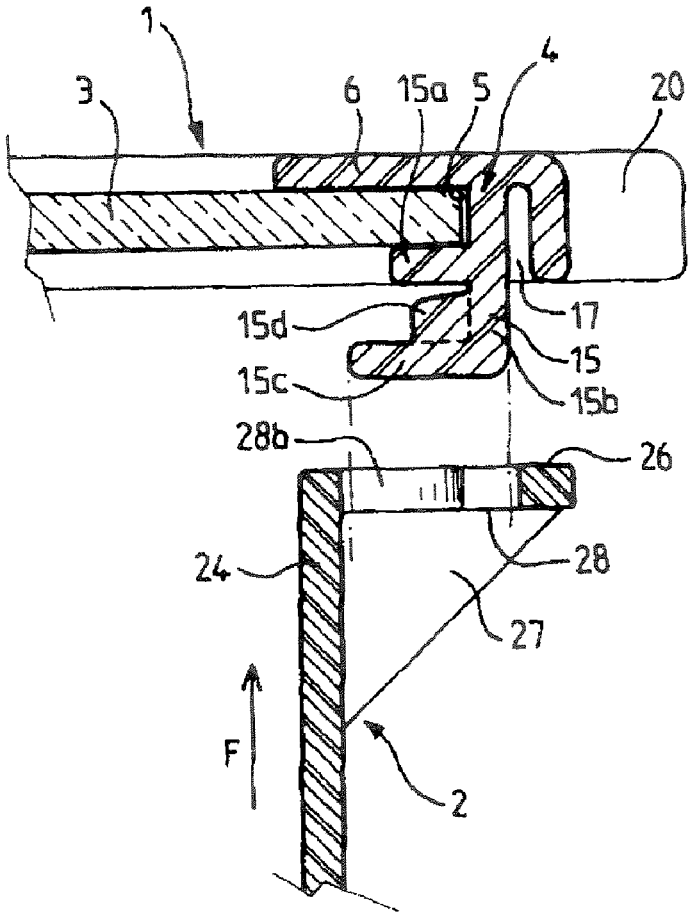
FIG. 5 is a view in section along V-V of FIG. 3.
Figure 6:
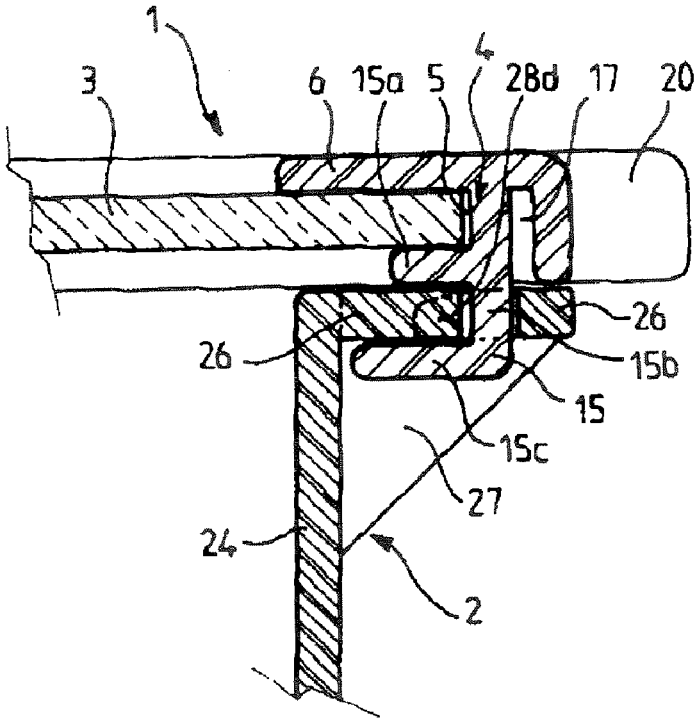
FIG. 6 is a view in section along VI-VI of FIG. 4.

The frame 4, of generally rectangular shape and flattened, comprises a part of actual surround, having a rectangular internal vertical wall 5, of a height slightly greater than the thickness of the glass panel 3 and enclosing the latter on all its thickness in the installation position (FIGS. 4 and 5). This figure shows a small distance between this wall 5 and the edge of the glass panel 3. However, this distance may be still smaller, even zero, depending on the chosen manufacturing method, in order to ensure a better retention and a better sealing of the assembly.

Figure 2:
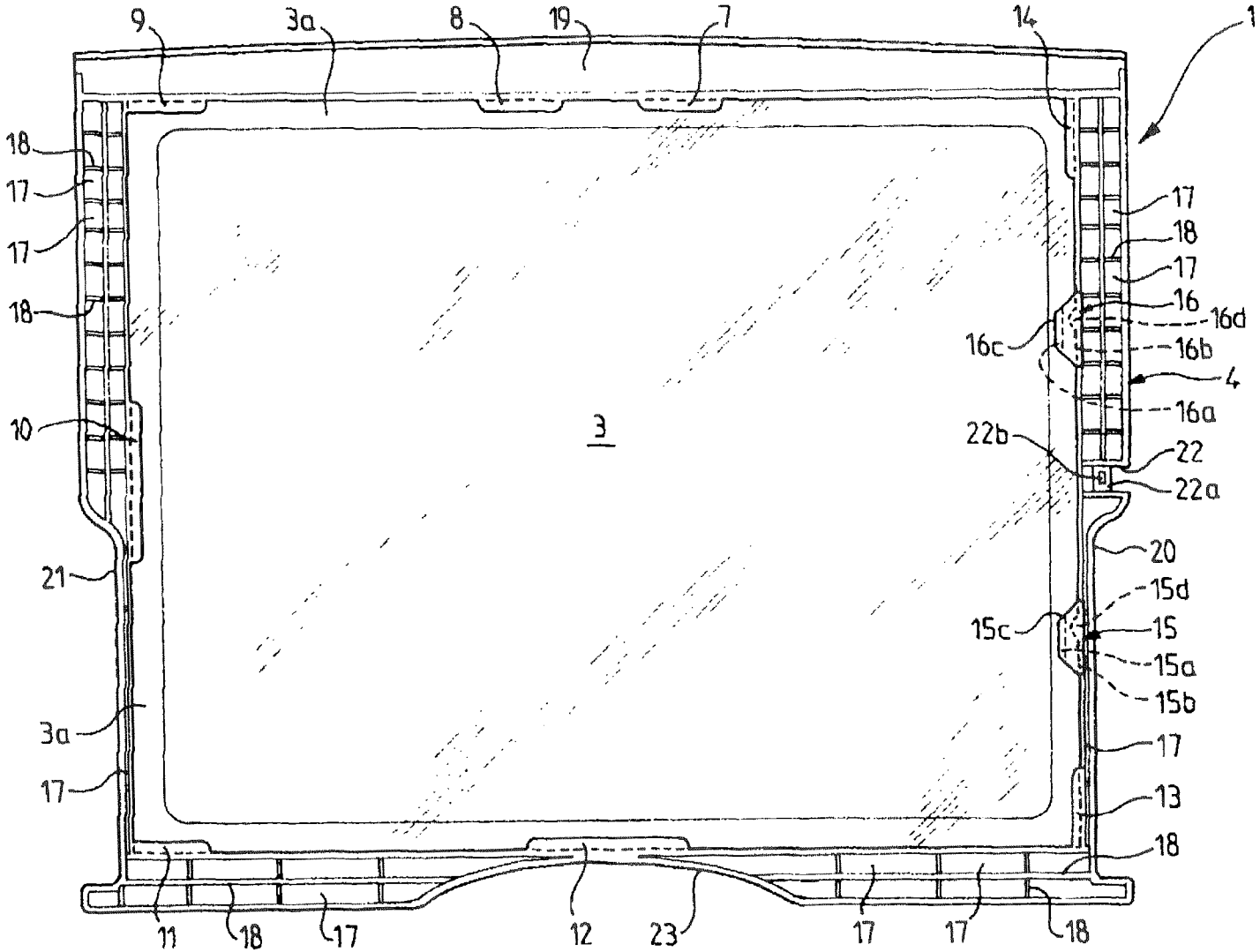
FIG. 2 is, on a larger scale, a view from beneath of the shelf of FIG. 1, without its bottle-holder accessory.
Figure 3:
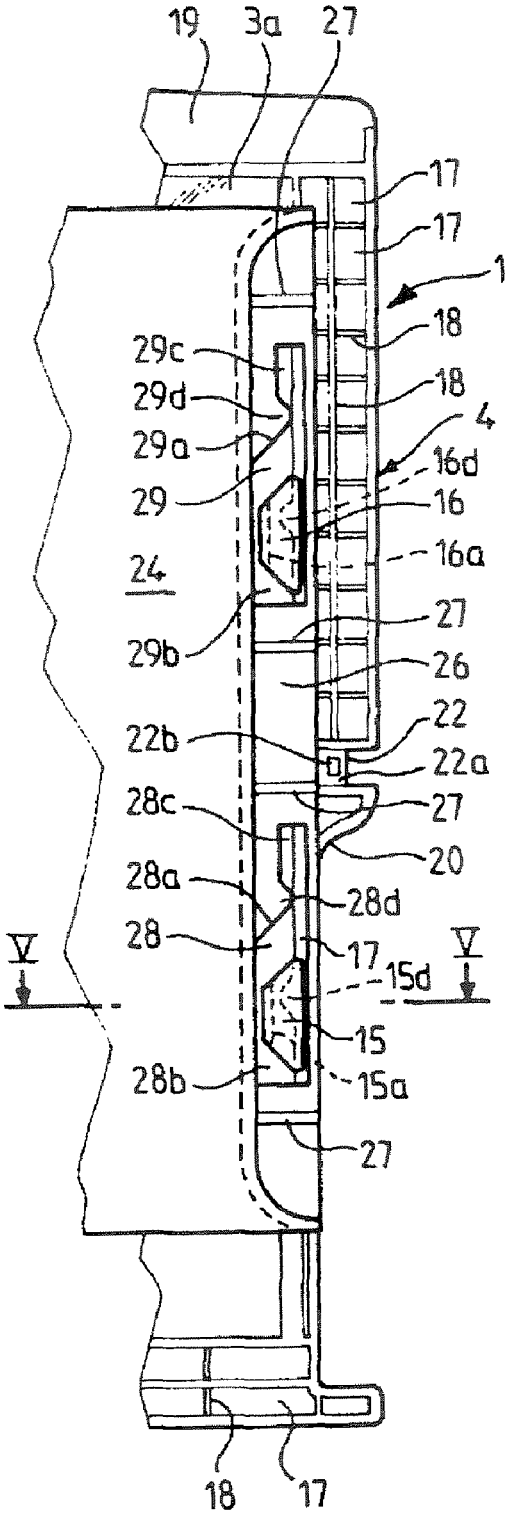
FIG. 3 is, on a yet larger scale, a partial view of FIG. 2, showing the right border of the shelf onto which the bottle-holder accessory is applied by its corresponding coupling rim, said accessory being represented only partially and being in its initial position from which it will be installed by clipping onto the underside of the shelf.

At its upper part and on its whole periphery, the frame 4 forms a thin rim 6 toward the interior, which comes to press (or apply) on the upper face of the glass panel 3, its free border forming, for example, a rectangle with rounded corners (FIG. 1). The upper face of the rim 6 is situated in the extension of the upper face of the actual surround of the frame 4, in order to form a perfectly smooth frame top 4. The lower face of the glass panel 3 is furnished, for example, with an enameled border 3*a* in correspondence with the upper rim 6 (FIGS. 2 to 4).

At its lower part, the actual surround of the frame 4 has internally several rims toward the inside, 7 to 14, 15*a* and 16*a*, which form as many thin maintaining lugs which are applied to the lower face of the glass panel 3.

These rims 7 to 14, 15*a* and 16*a*, distributed over the whole periphery of the frame 4 to provide a balanced retention of the latter, have an outer face situated in the same plane as the lower face of the frame 4. It will be noted however that this lower face of the frame 4 is not smooth like the upper face, but has, in its rear, right and left border regions, pocket recesses 17 separated by ribs 18, which saves material in these regions while maintaining a sufficient rigidity for the frame 4. These pocket recesses and ribs may be obtained by the "air molding" technique.

The distribution and the disposition of the lugs 7 to 14 and 15*a*, 16*a* is, in the example shown, as follows:

- two central lugs 7 and 8 and one left end lug 9 on the front edge of the frame 4;
- one central lug 10 on the left edge of the frame 4;
- one left end lug 11 and one central lug 12 on the rear edge of the frame 4; and
- end lugs 13 and 14 on the right edge of the frame, and lugs 15*a* and 16*a* substantially evenly disposed along this right edge.

A central lug (not shown) may advantageously be provided on the right edge of the frame 4, between the lugs 15*a* and 16*a*.

The lugs 7 to 14 have for example the general shape of elongated rectangles with rounded free corners, the lugs 10 and 12 in a central position being for example longer than the end lugs 7 to 9, 11, 13 and 14 particularly to provide a better distribution of the forces.

The lugs 15*a* and 16*a* here have the shape of trapezia whose small base is situated on a free border. These lugs 15*a* and 16*a* furthermore have the particular feature that each forms a flange of a U-shaped coupling element, respectively 15 and 16, which is molded in a single piece with the frame 4 and whose web, respectively 15*b*, 16*b*, comes in the extension of the internal border 5 of the actual surround of the frame 4, and the other flange, respectively 15*c*, 16*c*, comes as an overhang, overhanging the lower face of the glass panel 3 (FIGS. 2 to 4). The flanges 15*c* and 16*c* here are of the same trapezoidal shape as the flanges respectively 15*a*, 16*a*, but with a slightly greater width in the central parts.

Furthermore, in the vicinity of each of their front edges, the U-shaped elements respectively 15 and 16 comprise internally a boss respectively 15*d* and 16*d*, each supported by the external flange 15*c*, 16*c* and the web 15*b*, 16*b* of said U-shaped element 15, 16.

These U-shaped elements 15 and 16 form means intended to allow the positioning of the bottle-holder accessory 2 in order to achieve its coupling to the shelf 1, then its guidance in order finally to couple it by clipping as will be described hereinafter, in combination with complementary means supported by the bottle-holder accessory 2.

To complete the description of the shelf 1, it can be indicated that:

- the frame 4 is folded downward at its front part 19 in order to form a handle for the manipulation of the shelf 1;
- the right and left edges of the shelf 1 have, in the rear region, elongated indentations with curved edges respectively 20 and 21, the right edge also having in its central part a U-shaped indentation 22 whose web has a rib 22*a* furnished with a central hole 22*b* with an axis parallel to the internal border 5 of the frame 4;
- the rear edge of the shelf 1 has a central indentation 23 in an arc of a circle.

The role of these particularly shaped cut-outs of the edges of the shelf 1 depends on the chassis and the structure of the support (such as racks) of said shelf 1 in the refrigerator, and its method of insertion and removal (thus, it is normal to provide that, for reasons of safety, the shelf cannot be pulled straight out, being first pulled out over only a part of the latter). Not being part of the present invention and only being particular examples, these cut-outs and details will not be described here further.

The shelf 1 that has just been described is obtained by forming the plastic frame 4 by hot molding, the glass panel 3 being assembled to the frame 4 on leaving the mold before the complete retraction of the plastic. Details concerning this method (temperatures, duration of the steps, etc.) will be found in application PCT/FR02/00482 in the name of the filing Company.

It may however be emphasized that the glass panel 3 will be, during manufacture, advantageously put in place via the bottom face of the frame 4 between the various tabs 7 to 14 and the U-shaped elements 15 and 16, before the complete retraction of the structure of the frame. This gives a perfect fixed attachment of the assembly, because the panel 3 is sandwiched between the top rim 6 and the bottom tabs 7 to 14, 15*a* and 16*a*. This is of great practical importance, because in particular the shelf 1 is intended to support foodstuffs which may spread and slide into the plastic-glass junction zones, impairing the correct use of the refrigerator.

The bottle-holder accessory 2 as shown is advantageously formed by a rectangular plate 24 (here essentially solid) made of rigid plastic (advantageously similar or identical to that of the frame 4), such as polypropylene, folded on itself at one of its ends in a rounded form, in order to form a cradle 25 capable of receiving a bottle in the lying state.

At its end opposite to the cradle 25, the plate 24 is folded squarely on the side opposite said cradle 25 in order to form a flat rim 26 connected to the plate 24 by reinforcing ribs 27, of triangular shape, four in number in the example shown. The rim is slightly thinner than the distance between the two flanges of the U-shaped elements 15 and 16.

The plate 24 is connected to the rim 26 at its two ends, front and rear, along curved parts 24*a* (FIG. 1), giving an esthetic look to the bottle-holder 2.

In the rim 26 here, at equal distance from each of the rear and front ends, identical openings are made, respectively 28 and 29, each having the shape of an elongated rectangle placed along the length of the rim 26. The internal longitudinal edge of each of these openings 28, 29 has an oblique crank respectively 28*a*, 29*a* approximately on a third of its length, to form, for each of the openings, a wider rear region 28*b*, 29*b* and a narrower front region 28*c*, 29*c*.

In the zone of junction between the crank 28*a*, 29*a* and the front region 28*c*, 29*c*, the aforementioned internal longitudinal edge forms a bulge 28*d*, 29*d* toward the interior, whose role is indicated hereinafter.

When the user desires to couple the bottle-holder accessory 2 beneath the shelf 1, which is in place in the refrigerator, he comes to apply said accessory 2 via its rim 26 against the underside of the shelf 1, on the lugs 13 and 14, toward the front as shown in FIG. 3. In this position, the U-shaped elements 15 and 16 come level with the rear regions 28*b*, 29*b* of the openings 28 and 29 (arrow F in FIG. 5). This maneuver is easy because these rear regions of the openings 28, 29 are sufficiently long.

The external flanges 15*c*, 16*c* of the U-shaped elements then protrude beyond the rim 26. The bottle-holder 2 is in guidance position for being slid rearward in the direction of the arrow F' of FIG. 4. During this sliding movement, the bulged parts 28*d*, 29*d*, come between the two flanges of the U-shaped elements 15, 16, this entrance being made easier by the inclined ramp shape of the cranks 28*a*, 28*b* and of the flanges in question, then the bulges 28*c*, 28*d* come to clip behind the respective bosses 15*d*, 16*d*.

In this position, the bottle-holder accessory 2 is held vertically by the interweaving coupling of the rim 26 in the hook-like part formed by the U-shaped elements 15 and 16, and it is held in the horizontal plane on the one hand because the external borders of the openings 28, 29 retain the bottle-holder 2 and on the other hand due to the front border of the openings 28, 29 butting against the corresponding borders of the U-shaped elements.

The bottle-holder accessory 2 is removed by unclipping with the maneuvers that are the reverse of those that have just been described.

The arrangement of the hook-like parts (L-shaped) making it possible to suspend the bottle-holder accessory 2 in association with the maintaining lugs of the glass of the frame 4 prevents having to work the frame 4, and therefore leading to a loss of sealing between plastic and glass. In addition, these U-shaped elements 15, 16 in combination with the shape of the openings 28, 29 make it possible to retain the accessory both in the vertical direction and in the horizontal plane. The coupling of the accessory by a single side thanks to this system has an esthetic and practical advantage and is particularly satisfactory and sufficient (strength, durability, etc.).

It is well understood that the embodiment that has just been described has been given as an indication and is no limiting and that modifications may be made without for all that departing from the scope of the present invention.

The invention claimed is:

1. A shelf for a piece of furniture, or for a refrigerator, comprising:

- a panel for supporting articles;
- an accessory that is placed, in a position of use, in a free space of a corresponding side of the shelf; and
- at least one structure made of plastic on at least one region of a periphery of the panel,
- wherein the structure is configured to allow the shelf to be installed in a frame of the piece of furniture, wherein the structure supports, on one of two opposite faces of the structure that are situated in the plane of the panel, a first attachment mechanism which attaches the accessory, in the position of use, in the free space of the corresponding side of the shelf,
- wherein the accessory includes a second attachment mechanism,
- wherein one of the first and second attachment mechanisms includes two lugs which each include a boss on an interior thereof, and the other of the first and second attachment mechanisms includes two elongated openings that each include a bulged portion, and wherein, when the accessory is installed in the position of use, the accessory is supported on a single longitudinal side of the shelf by mutual engagement between the first and second attachment mechanisms such that the bulge of each respective one of the two elongated openings is clipped behind the boss of a corresponding one of the two lugs so as to prevent all movement of the accessory relative to the shelf in a horizontal plane that is substantially parallel to the panel once installed.

2. The shelf as claimed in claim 1, wherein the plastic structure is an added structure, or a structure assembled by retraction.

3. The shelf as claimed in claim 1, wherein each of the first and second attachment mechanism is configured to make it possible to install the accessory removably.

4. The shelf as claimed in claim 1, wherein the plastic structure comprises at least one rim applied to the panel for supporting articles on at least one of two opposite faces of the panel, the first attachment mechanism being supported by the rim.

5. A piece of furniture or a refrigerated cabinet, cooling apparatus, or refrigerator, comprising at least one shelf as defined in claim 1.

6. A shelf for a piece of furniture, or for a refrigerator, comprising:

a panel for supporting articles; and at least one structure made of plastic on at least one region of a periphery of the panel, wherein the structure is configured to allow the shelf to be installed in a frame of the piece of furniture, wherein the structure supports, at least on one of two opposite faces of the structure that are situated in the plane of the panel, an attachment mechanism which attaches an accessory intended to be placed, in a position of use, in a free space of a corresponding side of the shelf, wherein the attachment mechanism includes a portion that prevents all movement of the accessory relative to the shelf in a horizontal plane that is substantially parallel to the panel once installed, wherein the plastic structure comprises at least one rim applied to the panel for supporting articles on at least one of two opposite faces of the panel, the attachment mechanism for attaching the accessory or accessories being supported by the rim, and wherein the plastic structure includes a frame or a portion of frame enclosing the panel via a surrounding part, which has at least one rim coming to apply under the panel and forming at least one maintaining lug, at least one of the maintaining lugs supporting the mechanism for attaching an accessory.

7. A shelf for a piece of furniture, or for a refrigerator, comprising:

a panel for supporting articles; and at least one structure made of plastic on at least one region of a periphery of the panel, wherein the structure is configured to allow the shelf to be installed in a frame of the piece of furniture, wherein the structure supports, at least on one of two opposite faces of the structure that are situated in the plane of the panel, an attachment mechanism which attaches an accessory intended to be placed, in a position of use, in a free space of a corresponding side of the shelf, wherein the attachment mechanism includes a portion that prevents all movement of the accessory relative to the shelf in a horizontal plane that is substantially parallel to the panel once installed, and wherein the attachment mechanism includes a U-shaped element, wherein the plastic structure includes a frame or a portion of frame enclosing the panel via a surrounding part, and wherein a web of the U-shaped element is situated in an extension of the surrounding part of the frame which encloses the panel, and an external flange which overhangs the panel.

8. The shelf as claimed in claim 7, wherein a boss supported by the plastic structure is placed in the web of the U-shaped element and a boss supported by the accessory is formed by a bulge formed along a coupling border of the accessory, the coupling border having a thickness allowing the coupling boarder to come and be positioned between two flanges of the U-shaped element.

9. The shelf as claimed in claim 8, wherein the flanges of the U-shaped element have inclined borders, and the coupling border by which the accessory penetrates by sliding between the two flanges of the U-shaped element is in a form of a ramp to facilitate guidance followed by clipping of a boss supported by the accessory behind a boss supported internally by the U-shaped element.

10. A shelf for a piece of furniture, or for a refrigerator, comprising:

a panel for supporting articles; and at least one structure made of plastic on at least one region of a periphery of the panel, wherein the structure is configured to allow the shelf to be installed in a frame of the piece of furniture, wherein the structure supports, at least on one of two opposite faces of the structure that are situated in the plane of the panel, an attachment mechanism which attaches an accessory intended to be placed, in a position of use, in a free space of a corresponding side of the shelf, wherein the attachment mechanism includes a portion that prevents all movement of the accessory relative to the shelf in a horizontal plane that is substantially parallel to the panel once installed, and wherein the plastic structure comprises at least one rim applied to the panel for supporting articles on at least one of two opposite faces of the panel, the attachment mechanism for attaching the accessory or accessories being supported by the rim further comprising the accessory, wherein the accessory includes a rim for coupling the accessory to the shelf that comprises at least one elongated opening that includes an internal longitudinal edge that has a recess or crank to form a region that receives a U-shaped element of the shelf to pass and a coupling border part that supports a bulge which clips the shelf to the accessory, the opening allowing sliding guidance of the accessory to couple the accessory followed by clipping the shelf to the accessory, the accessory being retained in the horizontal plane by the external edge of the opening butting against the web of the U-shaped element of the shelf and by an edge of the U-shaped element butting against a transverse side of the opening, opposite a region in which the bulge is secured.

11. A shelf for a piece of furniture, or for a refrigerator, comprising:

a panel for supporting articles; and at least one structure made of plastic on at least one region of a periphery of the panel, wherein the structure is configured to allow the shelf to be installed in a frame of the piece of furniture, wherein the structure supports, at least on one of two opposite faces of the structure that are situated in the plane of the panel, an attachment mechanism which attaches an accessory intended to be placed, in a position of use, in a free space of a corresponding side of the shelf, wherein the attachment mechanism includes a portion that prevents all movement of the accessory relative to the shelf in a horizontal plane that is substantially parallel to the panel once installed, and wherein the attachment mechanism includes at least two separate and distinct U-shaped elements that extend below the structure and are spaced apart from each other on a single longitudinal side of the shelf.

12. An accessory for a shelf as defined in claim 11.

13. A shelf for a piece of furniture, or for a refrigerator, comprising:

a panel for supporting articles;

at least one structure made of plastic on at least one region of a periphery of the panel, wherein the structure is configured to allow the shelf to be installed in a frame of the piece of furniture, wherein the structure supports, at least on one of two opposite faces of the structure that are situated in the plane of the panel, attachment means for attaching an accessory intended to be placed, in a position of use, in a free space of a corresponding side of the shelf, and wherein the plastic structure comprises at least one rim applied to the panel for supporting articles on at least one of two opposite faces of the panel, the attachment means for attaching the accessory or accessories being supported by the rim; and at least one of the accessory, wherein the accessory includes a rim for coupling the accessory to the shelf that comprises at least one elongated opening that includes an internal longitudinal edge that has a recess or crank to form a region that receives a U-shaped element of the shelf to pass and a coupling border part that supports a bulge which clips the shelf to the accessory, the opening allowing sliding guidance of the accessory to couple the accessory followed by clipping the shelf to the accessory, the accessory being retained in the horizontal plane by the external edge of the opening butting against the web of the U-shaped element of the shelf and by an edge of the U-shaped element butting against a transverse side of the opening, opposite a region in which the bulge is secured.

14. A shelf for a piece of furniture, or for a refrigerator, comprising:

a panel for supporting articles;

at least one structure made of plastic on at least one region of a periphery of the panel, wherein the structure is configured to allow the shelf to be installed in a frame of the piece of furniture, wherein the structure supports, at least on one of two opposite faces of the structure that are situated in the plane of the panel, attachment means for attaching an accessory intended to be placed, in a position of use, in a free space of a corresponding side of the shelf; and means for preventing a relative movement of an accessory intended to be placed, in a position of use, in a free space of a corresponding side of the shelf in a horizontal plane that is substantially parallel to the panel once installed, wherein the attachment means includes a U-shaped element, wherein the plastic structure includes a frame or a portion of frame enclosing the panel via a surrounding part, wherein a web of the U-shaped element is situated in an extension of the surrounding part of the frame which encloses the panel, and an external flange which overhangs the panel, and wherein flanges of the U-shaped element have inclined borders, and a border by which an accessory intended to be placed, in a position of use, in a free space of a corresponding side of the shelf penetrates by sliding between the two flanges of the U-shaped element is in a form of a ramp to facilitate guidance followed by clipping of a boss supported by the accessory behind a boss supported internally by the U-shaped element.

15. A shelf for a piece of furniture, or for a refrigerator, comprising:

a panel for supporting articles;

at least one structure made of plastic on at least one region of a periphery of the panel, wherein the structure is configured to allow the shelf to be installed in a frame of the piece of furniture, and wherein the structure includes, on at least one of two opposite faces of the structure that are situated in the plane of the panel, an attachment mechanism that includes at least one U-shaped element; and at least one accessory which attaches to the structure via the attachment mechanism so as to be positioned in a free space of a corresponding side of the shelf, the accessory including a horizontally extending rim that includes an elongated opening which engages with the U-shaped element of the shelf, the elongated opening including an internal longitudinal edge that includes a recess or crank to form a region for the U-shaped element of the shelf to pass therethrough and a coupling border part that includes a bulge which clips the shelf to the accessory.

* * * * *

UNITED STATES PATENT AND TRADEMARK OFFICE

CERTIFICATE OF CORRECTION

PATENT NO. : 7,950,755 B2
APPLICATION NO. : 11/720610
DATED : May 31, 2011
INVENTOR(S) : Francois Vardon It is certified that error appears in the above-identified patent and that said Letters Patent is hereby corrected as shown below:

On the title page, Item (54), and column 1, line 1, the title is incorrect. Item (54) and column 1, line 1, should read:

-- SHELF, PARTICULARLY FOR REFRIGERATED INSTALLATIONS, SUITABLE FOR SUPPORTING AT LEAST ONE ACCESSORY, AND CORRESPONDING ACCESSORIES --

Signed and Sealed this
Ninth Day of August, 2011

David J. Kappos

David J. Kappos
*Director of the United States Patent and Trademark Office*